United States Patent [19]

Kronfeld

[11] 4,113,141

[45] Sep. 12, 1978

[54] DISPENSER PACKAGE FOR MAGNETIC TAPE SPLICING TABS

[75] Inventor: Mervin B. Kronfeld, Edina, Minn.

[73] Assignee: Nortronics Company, Inc., Minneapolis, Minn.

[21] Appl. No.: 734,363

[22] Filed: Oct. 20, 1976

[51] Int. Cl.[2] ..... B65H 5/28

[52] U.S. Cl. ..... 221/70; 206/409; 206/820

[58] Field of Search ..... 221/70–74; 206/409, 820

[56] References Cited

U.S. PATENT DOCUMENTS

| | | | |
|---|---|---|---|
| 2,574,565 | 11/1951 | Hough et al. | 221/71 X |
| 3,128,012 | 4/1964 | Berg | 221/70 |
| 3,628,692 | 12/1971 | Blatz | 221/70 |
| 3,663,343 | 5/1972 | Buck | 428/41 |

FOREIGN PATENT DOCUMENTS

| | | | |
|---|---|---|---|
| 1,322,187 | 2/1963 | France | 206/409 |
| 1,348,529 | 12/1963 | France | 221/70 |
| 94,409 | 6/1959 | Norway | 206/820 |

*Primary Examiner*—Robert B. Reeves
*Assistant Examiner*—Francis J. Bartuska
*Attorney, Agent, or Firm*—Merchant, Gould, Smith, Edell, Welter & Schmidt

[57] ABSTRACT

A device, and method for assembling same, is disclosed for the itemized dispensing of tabs having an adhesive coating on one side thereof, which tabs are polygonally shaped and obliquely, releasably mounted on a rolled strip of backing material. The device comprises a roll of such tabs disposed within a box having one side thereof with a triangularly shaped opening in its lower end. The triangular opening is defined by the box edge adjacent the opening and the lower side edge, which intersects the box edge at the angle of obliquity at which the tabs are disposed on the backing strip. As the backing strip is drawn through the opening, the leading edge of a tab will be exposed free and clear of the box edge, and the entire tab will be exposed free and clear of the lower side edge, whereby the tab may be peeled from the backing strip. As the leading edge of a tab is exposed free and clear of the lower box edge, one, and only one, entire tab is exposed exterior of the box.

3 Claims, 10 Drawing Figures

DISPENSER PACKAGE FOR MAGNETIC TAPE SPLICING TABS

BACKGROUND OF THE INVENTION

1. Field of the Invention

This invention relates to the field of devices for dispensing tabs having an adhesive coating on one surface thereof. More particularly, this invention relates to the field of devices for the itemized dispensing of a plurality of pressure-sensitive tabs for the splicing of magnetic recording tape, from a roll carrying a plurality of such tabs.

2. Description of the Prior Art

There are many fields in which a plurality of pressure-sensitive labels, tags, tabs, etc. are used. For example, a grocery store, or other retail outlet has occasion to use pressure-sensitive price tags on merchandise. Consequently, it is useful to have a plurality of such tags in a form that is readily, and easily usable. One such form is a plurality of tags mounted on a backing strip having a slick surface, whereby the tags are easily peelable therefrom without damaging the pressure-sensitive characteristics of the tags. Thus, a plurality of tags may be mounted releasably on a strip of carrier material, and the carrier strip rolled into a compact unit.

Devices for dispensing labels or tags from such rolls have been developed. Such dispensers are generally in the form of a box, wherein is housed the roll of labels, having a slot on one corner edge thereof, through which is threaded the roll of labels. Provision is then made for bending the strip around a right-angle corner with the result that, as the strip passes around the corner, the labels adhering thereto may be peeled from the backing strip. Two examples of such dispensers are those disclosed in the patent to Avery, U.S. Pat. No. 2,372,245 and Kasper, U.S. Pat. No. 2,838,171. A problem present in such dispensers is the fact that in order to peel the label from the strip, one must handle the adhesively coated side of the label, thus impairing to some extent its pressure-sensitive qualities. In applications where it is necessary that the adhesive side of the tab not be handled, this is a fatal defect. For instance, when it becomes necessary to splice together two lengths of magnetic recording tape with a strip of splicer tape, the handling of the adhesively coated side of the pressure-sensitive tape would damage the splicer tape strip sufficiently to cause an unacceptable splice.

For the above-cited reason, short strips of splicing tape have been adapted to be releasably fixed on a handling strip; an entire tab, comprising handling strip and splicing strip, is then releasably mounted on a flexible carrying or backing strip in roll form. It is also well known that, because of the characteristics of magnetic recording tape, splices in such tape are best made by abutting opposed ends of the tape which ends have been sliced at an oblique angle, rather than at a right angle. Similarly, the splicing tape used should be sliced at oblique angles, rather than at right angles. Consequently, the strips of splicing tape utilized in the aforesaid tabs are trapezoidal in shape, as are the elongated handling strips. For purposes of commercial expediency, these tabs are mounted at an oblique angle on the carrier, or backing strip.

Label dispensers of the type previously mentioned have proven unsatisfactory for the itemized dispensing of the above-described splicer tape tabs. This is so because the oblique mounting of a plurality of elongated handling strips, in close spaced relationship to one another on the backing strip requires that in order to draw one tab clear of the housing and across the bending edge, whereby it may be peeled from the backing strip, at least a portion of the next succeeding strip must also be drawn across the bending edge, thus exposing the tab to the exterior of the housing, and to potential damage due to dust, handling, etc.

SUMMARY OF THE INVENTION

It is a feature of the present invention that a dispensing device is provided which dispenses a plurality of pressure-sensitive tabs from a protective housing one at a time.

It is another feature of the present invention that a dispensing box is provided with an opening in one side thereof adjacent a peeling edge, the opening being of such a shape, and in such spaced relationship with the peeling edge, that as one adhesive tab is dispensed from the box, the remainder of the tabs, being obliquely disposed on the carrier strip remain protected by the box, and particularly, no portion of the next succeeding tab on the carrier strip is drawn across the peeling edge of the box.

The above-cited features are accomplished by providing a dispensing unit comprising a plurality of the pressure-sensitive tabs, obliquely mounted on a roll of flexible backing material, said roll of tabs being housed in a box. The box is provided with an opening through which a strip of backing material with tabs thereon may be threadedly withdrawn, and adjacent the opening, there is provided a peeling edge, which is disposed normal to the direction of withdrawal of the strip. Preferably, the peeling edge defines the lower edge of the opening. The upper edge of the opening is disposed at an angle with the peeling edge, which is equal to the angle of obliquity at which the tabs are mounted on the backing strip. Provision is made for the strip to be drawn around the peeling edge, and it will be appreciated that this configuration allows for the leading tip of a tab to pass over the peeling edge as the entire tab clears the upper edge of the opening, whereby it may be easily peeled from the backing strip, while at the same time assuring that no portion of the next succeeding tab need be drawn across the peeling edge. Thus, one adhesive tab may be dispensed from the housing, without exposing the others contained within the housing to damage.

BRIEF DESCRIPTION OF THE DRAWINGS

Referring now to the drawings, the assembled box, which comprises an element of the present invention, will be generally designated by the numeral 10. The blank from which box 10 is assembled will be generally designated by the numeral 11. Referring now to FIG. 10, blank 11 is shown. The major portions of blank 11 comprise pre-back portion 13, first pre-side portion 14, pre-front portion 15, second pre-side portion 16, pre-top portion 17, and pre-bottom portion 18. Associated with pre-back portion 13 are glue flap 19, guide means flap 20, guide means flap tongue 21, and lappet 22. A first hanger punchout portion 23 in pre-back portion 13 corresponds with a second hanger punchout portion 24 in lappet 22. Lappet 22 has cut-away corners **25*a* and 25*b*, and guide means flap tongue 21 has shallow notches 26*a* and 26*b* at the point where it joins guide means flap 20**.

Figure 1:
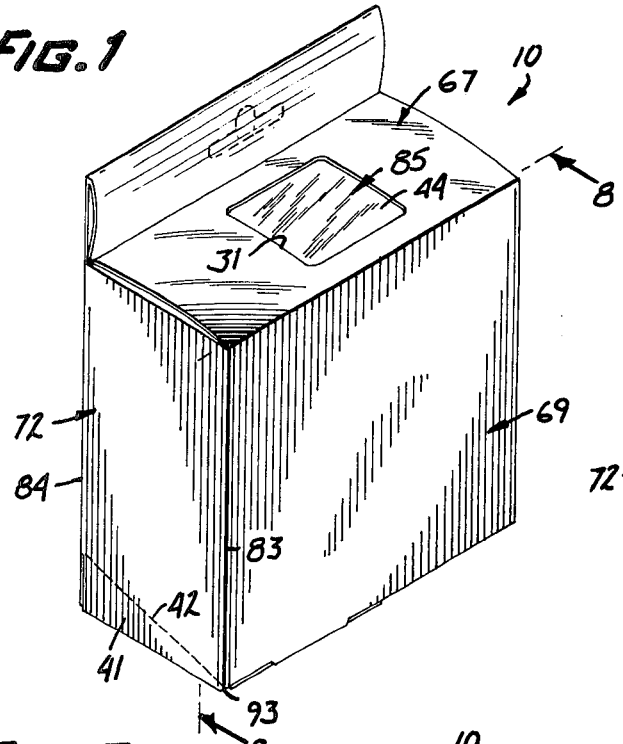
Fig. 1 is a view in perspective of the box of the present invention, showing the top and front thereof.

Associated with first pre-side portion 14 are a first tang 27 having a cut-away edge 28, and a third tang 29 having cut-away edge 30.

Associated with pre-top 17 are view opening 31, and top tongue 32 having beveled edges **33*a* and 33*b* and deep notches 34*a* and 34*b***.

Associated with pre-bottom portion 18 are bottom tongue 35, having beveled edge 36 and dust lip 37 thereon, as well as deep notch 38.

Associated with second pre-side portion 16 are second tang 39 having cut-away edge 40, disposable flap portion 41, being separated from second pre-side portion 16 by perforation line 42 and tuckdown flap 43.

It is preferred that blank 11 be stamped out of a sheet of cardboard by a die. All of the fold lines to be hereinafter enumerated should likewise be impressed on blank 11 by said die. Before assembling blank 11 into box 10, a piece of cellophane, or like transparent material, indicated by the number 44 in FIG. 1, should be affixed to the underside of pre-top portion 17, covering view opening 31.

With the exceptions noted, all of the following bends along the to-be-enumerated fold lines are bends of 90°. To assemble blank 11 into box 10, then, glue flap 19 is bent along first fold line 45 and pre-back portion 13 is bent along second fold line 46 to bring glue flap 19 parallel with first preside 14. Pre-front portion 15 is bent along third fold line 47 to bring pre-front portion 15 into parallel spaced relationship with pre-back portion 13, a layer of glue is applied to glue flap 19, and second pre-side portion 16 is bent along fourth fold line 48 to bring second pre-side 16 into contact with glue flap 19 and into parallel spaced relationship with first pre-side 14; by virtue of the layer of glue between glue flap 19 and second pre-side 16, pre-back portion 13, first pre-side portion 14, pre-front portion 15, and second pre-side 16, are held in an open ended box structure.

With the structure as mentioned above, lappet 22 is folded 180 degrees along fifth fold line 49, so as to bring second hanger punchout 24 into overlying relationship with first hanger punchout 23. First tang 27 is bent along sixth fold line 50 so that it lies between pre-back 13 and pre-front 15. In a like manner, second tang 39 is bent along seventh fold line 51 so that it lies between pre-back 13 and pre-front 15.

Top tongue 32 is then folded along eighth fold line 52, and pre-top 17 is bent along ninth fold line 53 to bring it into overlying relationship with first and second tangs 27 and 39. As part of this operation, top tongue 32 is tucked into the slot generally defined by cut-away edges 28 and 40 and a portion of lappet 22. When so tucked in, top tongue 32 lies flush against a portion of lappet 22 and a portion of pre-back 13; the interaction of deep notches **34*a* and 34*b* with step portions 54*a* and 54*b* of cut-away edges 28 and 40 locks pre-top 17 in this position. Since notches 34*a* and 34*b* are relatively deeply cut into fold line 52, pre-top 17 is more or less permanently locked in position, and it is not intended that box 10** be opened from the top, once assembled.

Third tang 29 is now bent along tenth fold line 55, whereby it is brought parallel with pre-top 17, between pre-back 13 and pre-front 15.

Bottom tongue 35 is bent along eleventh fold line 56 and pre-bottom 18 is bent along twelfth fold line 57, whereby it is brought parallel to pre-top 17. When pre-bottom 18 is brought into the aforesaid position, bottom tongue 35 is tucked into the slot generally defined by cut-away edge 30 and pre-back 13, whereby bottom tongue 35 lies flush against a portion of pre-back 13, and the interaction of deep notch 38 with step portion 58 acts to hold pre-bottom 18 in the aforesaid position. By virtue of the fact that notch 38 is deeply cut in fold line 56, pre-bottom 18 is more or less permanently locked in the aforesaid position, and it is not intended that box 10 be opened from the bottom once assembled.

It will be noted, when viewing the box 10, as partially assembled by the steps enumerated to this point, that second preside 16 is in a fixed relationship with pre-back 13 by virtue of the previously enumerated glueing step involving glue flap 19. This fixed relationship is such that, in its bent position, step portion **54*b* of second tang 39 abutts a portion of glue flap 19 at that point indicated by the number 59 where glue flap 19 joins pre-back 13. This means that, by virtue of the glueing, the juncture of second pre-side 16 and pre-back 13 is entirely sealed from seventh fold line 51 to the point, indicated by the numeral 60, where glue flap 19 joins the lower portion of pre-back 13. Disposable flap 41 is an extension of second pre-side portion 16, being separated therefrom by perforated line 42. Perforated line 42 runs at an angle from the corner where second pre-side 16 meets pre-front 15 and pre-bottom 18 to the point 60 where second pre-side 16 overlies glue flap 19. A right triangle is formed by perforated line 42, thirteenth fold line 61 and disposable flap edge 62. It will be noted that the line of juncture between second pre-side 16 and pre-back 13 is not sealed along the portion where disposable flap edge 62 abutts pre-back portion 13. It is in this gap that dust lip 37 of bottom tongue 35 is disposed when pre-bottom 18 is locked in its assembled position. Dust lip 37 is a short extension of bottom tongue 35, being only long enough to curl generally towards the plane of second pre-side 16, whereby disposable flap edge 62 overlies it to provide a barrier against dust or other matter's entry into the assembled box 10**.

Figure 10:
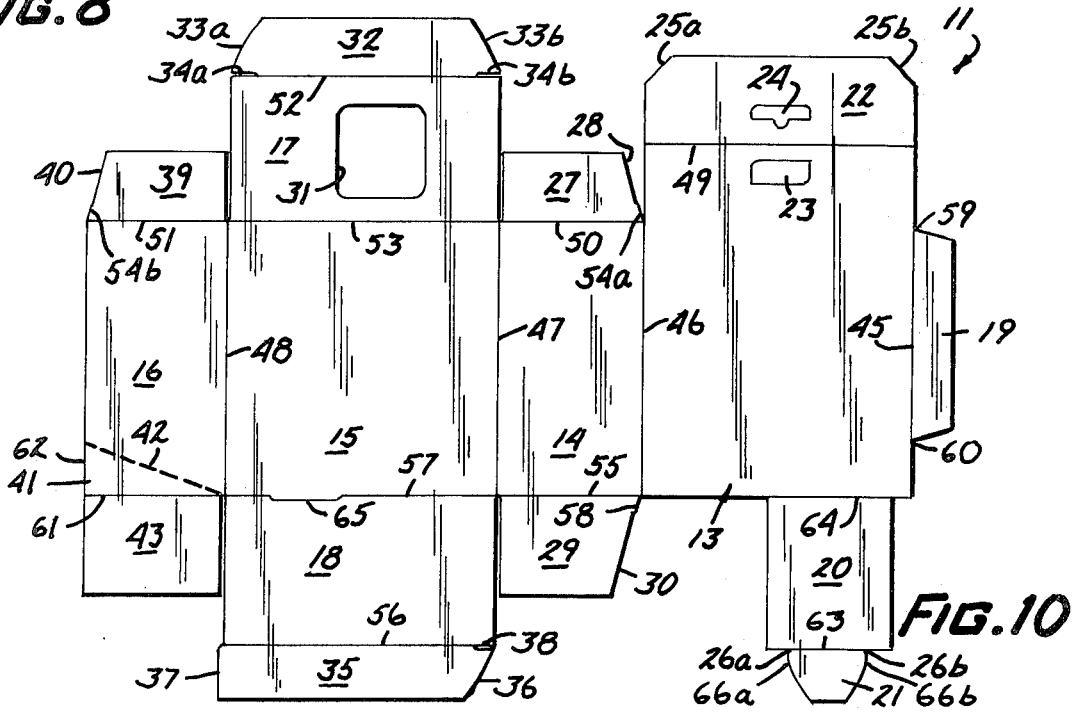
FIG. 10 is a generated view of the box shown in FIG. 1.

The final steps of assembly comprise the bending of tuckdown flap 43 along thirteenth fold line 61, whereby it is brought into overlying relationship with pre-bottom 18, the bending of guide means flap tongue 21 along fourteenth fold line 63 and the bending of guide means flap 20 along fifteenth fold line 64, whereby it is brought into overlying relationship with tuckdown flap 43. A slot 65 is provided along twelfth fold line 57 to receive guide means flap tongue 21. As will be noted from FIG. 10, slot 65 has slightly up-turned end portions, and the length of slot 65, including the length of the up-turned portion is generally equal to the width of guide means flap tongue 21 measured across shoulders *66a, 66b;* the length of slot 65, not including the up-turned ends is generally equal to the width of guide means flap tongue 21 between shallow notches *26a* and *26b,* whereby guide means flap tongue 21 is locked into slot 65 when placed therein, but is easily removable therefrom. As will be seen, it is intended that guide means flap tongue 21 may be removed from slot 65 after box 10 has been assembled.

Figure 2:
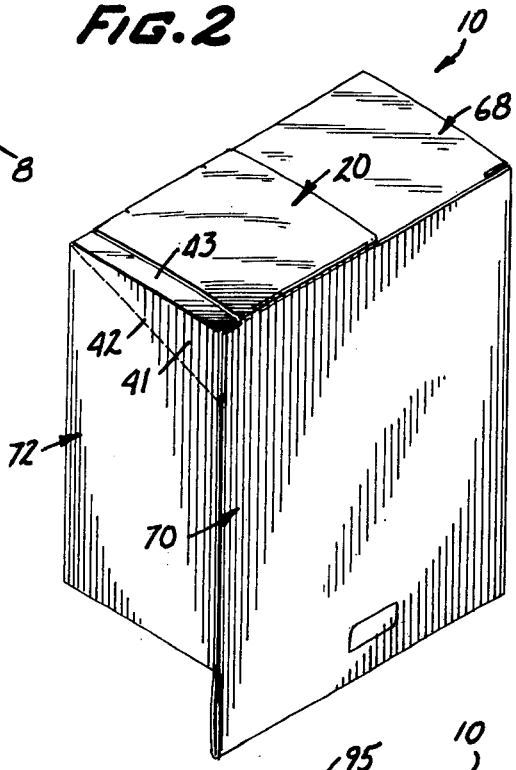
FIG. 2 is a view in perspective of the box of the present invention, showing the bottom and back thereof.

Referring now to FIGS. 1 and 2, once the above enumerated steps have been carried out on blank 11, a box 10 is formed, having a top 67, a bottom 68, a front 69, a back 70, a first-side 71 and a second side 72.

Figure 7:
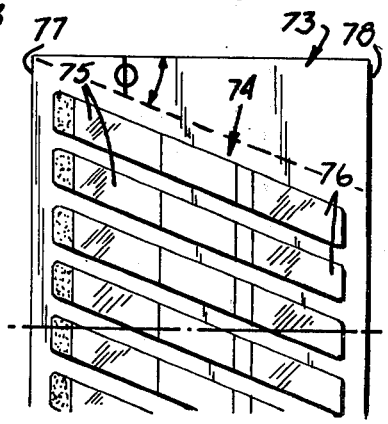
FIG. 7 is a top plan view of a portion of the tab carrying surface of the backing strip with tabs affixed thereto.

Referring now to FIG. 7, there is shown a portion of a length of flexible backing material, generally indicated by the numeral 73, with a plurality of adhesive tabs 74 disposed thereon. The tabs are polygonal in shape, being trapezoidal in the preferred embodiment, each having a leading, handle portion 75 and a trailing portion 76. Backing material 73 has parallel front and back edges 77 and 78 and in width is only slightly less than the width of sides 71 and 72 of box 10. Tabs 74 are obliquely disposed on backing member 73, at an angle of obliquity generally indicated by the symbol $\phi$ (PHI), and are in such parallel, spaced relationship with one another that a line drawn through the trailing portion 76 of any tab 74 said line intersecting front edges 77 and 78 perpendicularly thereof, will pass through a portion of at least one other tab 74, as shown in FIG. 7. In the preferred embodiment, a leader 95, being a reinforced piece of cardboard or pasteboard having edge extensions 77' and 78' of roll edges 77 and 78, is affixed at the beginning of this strip of backing material 73.

Figure 5:
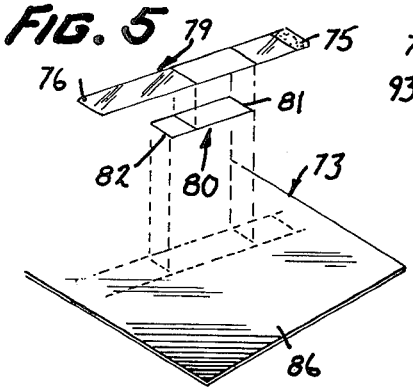
FIG. 5 is an exploded perspective view of an adhesive tab, and its relation to the backing strip.

The structure of tabs 74 is more clearly shown in FIG. 5. Each tab 74 comprises an elongated handling strip 79, preferably of a clear, relatively flexible plastic material, overlying a smaller length of adhesive material 80. In the preferred embodiment, the adhesive material 80 is suitable for splicing lengths of magnetic recording tape. These splicer tabs 80 are also trapezoidal in shape, having leading edges 81 and trailing edges 82, which edges demarcate the leading and trailing portions 75 and 76 of tabs 74. Splicer tabs 80 have an adhesive coating along their surface which overlies backing member 73. Backing member 73 has a slick tab-carrying surface 86. Handling strips 79 have an adhesive coating along a portion of their length which overlies a portion of splicer tabs 80. This adhesive coating extends from splicer tab leading edge 81 to a point short of splicer tab trailing edge 82. By virtue of the two adhesive coating layers, tabs 74 are mounted on backing 73: splicer tabs 80 being mounted on backing material 73 by virtue of the first adhesive coating layer and handling strips 79 being mounted on splicer tabs 80 by the second adhesive coating.

A splicer tab 80 may be removed from backing material 73 by grasping leading, handle portion 75 of tab 74 and peeling it back. Splicer tab 80 may then be pressed on to another surface such as a layer of magnetic tape, and by grasping trailing portion of tab 74, and peeling it back, handling strip 79 may be separated from splicer tab 80, leaving splicer tab 80 affixed to the new material.

Figure 8:
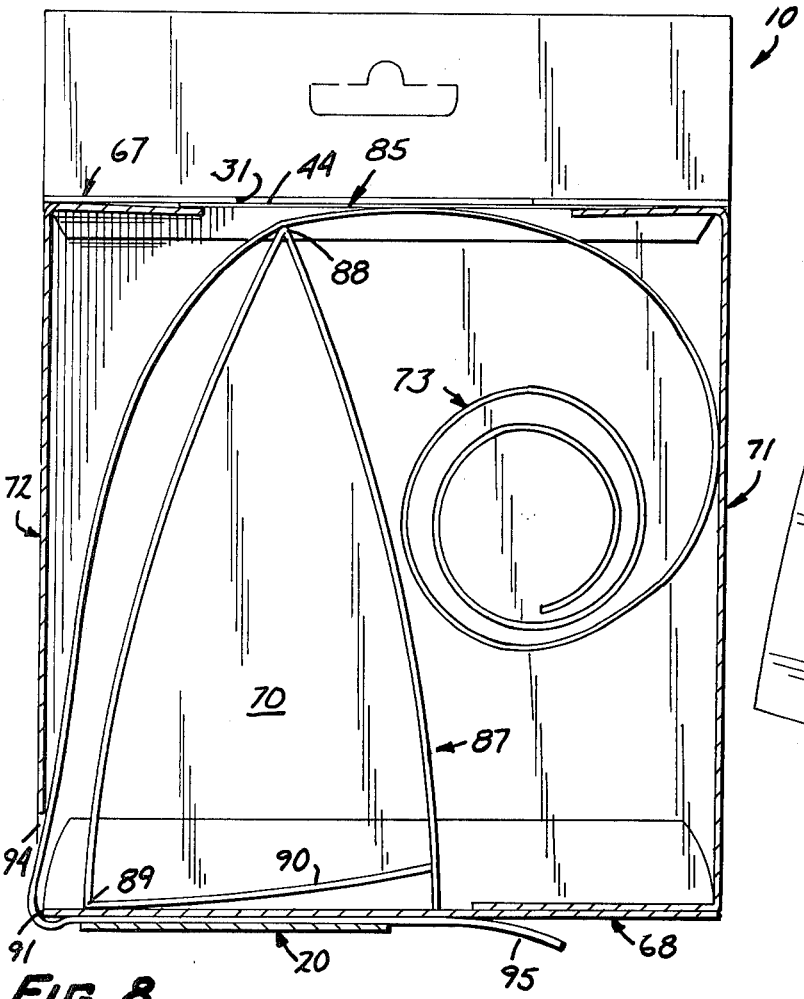
FIG. 8 is a sectional view along the line 8—8 of FIG. 1.
Figure 9:
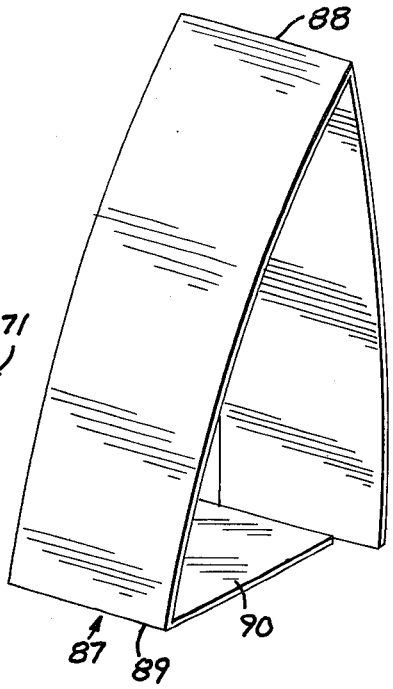
FIG. 9 is a perspective view of the spacer element shown in FIG. 8.

Referring again to FIG. 1, side 72 has a front edge 83, being along the line where side 72 joins front 69, and a back edge 84, being along the line where side 72 joins back 70. View opening 31, in combination with cellophane 44, forms a window 85 in top 67, which provides a means for alerting a user that the number of tabs in box 10 is approaching zero. As shown in FIG. 8, backing strip 73 is disposed within box 10 in rolled form, in such a way that tab carrying surface 86 of strip 73 passes by window 85. Means for guiding strip 73 past window 85 are provided in the form of a spacer 87 disposed within box 10. In the preferred embodiment, spacer 87 is simply a strip of cardboard, as shown in FIG. 9, being in width slightly less than the width of strip 73. Spacer cardboard 87 has a peak fold line 88 and a base fold line 89, along which lines cardboard spacer 87 is folded to produce a self-standing peaked structure, being in height slightly less than the interior height of box 10. The base portion 90 acts to maintain a spaced relationship between the two legs of spacer 87. Backing strip 73, in its rolled form, and spacer 87 are inserted into the box 10, preferably from the bottom side of box 10, before box 10 is fully assembled. Spacer 87 is placed between the bulk of the rolled backing strip 73 and side 72. Backing strip 73 is then threaded over the peak fold line 88 of spacer 87 and then downwardly until a portion of leader 95 lies adjacent disposable flap 42, with a portion of leader edge 77' adjacent edge 83 of side 72 and a portion of leader edge 78' adjacent back edge 84 of side 72. The lower flaps of box 10 are then closed, as previously enumerated, and the dispensing unit is in a complete, pre-use state.

Figure 3:
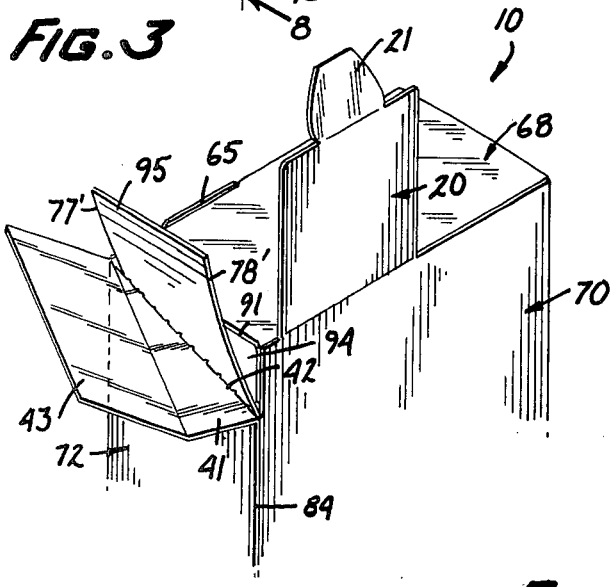
FIG. 3 is a view in perspective of a portion of FIG. 2, showing portions of the box moved to a second position, with a portion of the backing strip of the present invention withdrawn therefrom.
Figure 4:
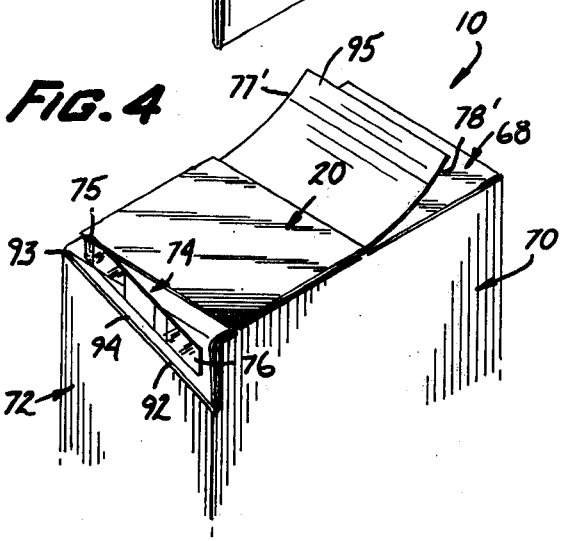
FIG. 4 is a perspective view of a portion of the present invention illustrating its operation.
Figure 6:
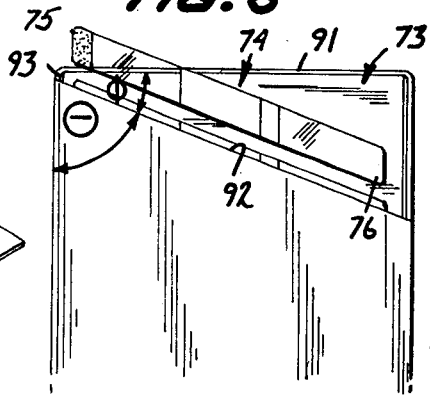
FIG. 6 is a side plan view of a portion of FIG. 4.

To use the unit, guide means 20 is released from its locked position by extracting guide means flap tongue 21 from slot 65, as shown in FIG. 3. Tuckdown flap 43 is then released, whereby it can be utilized as a handle for tearing disposable flap 41 away from side 72 along perforation line 42. This exposes a right-triangularly shaped opening 94 defined by the side edge 91 of bottom 68 and the lower edge 92 of side 72, in the plane of side 72 and side edge 91. This configuration is most clearly shown in FIGS. 4 and 6. As is shown, lower edge 92 is defined by the perforation line 42, after disposable flap 41 has been removed along said line. Lower edge 92 intersects side edge 91 at the corner 93 where side 72, front 69, and bottom 68 meet, at the angle $\phi$ (PHI), being the angle of obliquity at which the tabs 74 are disposed on backing strip 73. It will be appreciated that the complementary angle, $\theta$ (THETA), of the angle of obliquity, $\phi$ (PHI), is the angle at which a line extending along a tab 74 intersects front strip edge 77, and is also the angle at which lower side edge 92 intersects front side edge 83.

Once the opening 94 in side 72 has been created, a portion of a leader 95 appended to strip 73 will be exposed adjacent to opening 94. Leader 95 can be threaded through opening 94, and around edge 91, whereby it is brought into overlying relationship with bottom 68. Guide means flap 20 can then be returned to its locked position, with guide means flap 21 inserted in slot 65, thereby holding leader 95 against bottom 68, but in slidable relationship thereto. Thus, guide flap 20 acts as a means for guiding strip 73 through opening 94 and over edge 91. By drawing leader 95 along bottom 68 and away from opening 94, strip 73 will be drawn around peeling edge 91, and a tab 74 will be exposed in opening 94. As the handle portion 75 crosses edge 91, one entire tab 74 is exposed clear of lower edge 92, and exterior of box 10. As strip 73 makes the bend around peeling edge 91, the leading portion 75 of a tab 74 presents itself free and clear of box 10 and strip 73, thereby providing an easibly graspable portion of tab 74. Since splicer tab 80 is to be further used in a magnetic tape recorder, it is not desirable that it be handled at all, and this dispensing means assures that result. It is important to note that as the leading portion 75 of a tab 74 presents itself free and clear of edge 91 and box 10, the entire tab 74 is presented exterior the box 10, whereby it may be peeled from strip 73, and no other tab 74 is exposed exterior the box, thereby protecting other tabs on the roll for future use.

By following the aforementioned procedure, tabs 74 can be dispensed in itemized fashion from box 10, while protecting tabs remaining on backing strip 73 from any damage due to to handling, etc.

Numerous characteristics and advantages of my invention have been set forth in the foregoing description, together with details of the structure and function of the invention, and the novel features thereof are pointed out in the appended claims. The disclosure, however, is illustrative only, and changes may be made in detail especially in matters of shape, size, and arrangement of parts, within the principle of the invention, to the full extent indicated by the broad general meaning of the terms in which the appended claims are expressed.

What is claimed is:

1. A dispensing unit for the itemized dispensing of adhesive tabs comprising:

(a) a roll of flexible backing material having parallel front and back edges;

(b) a plurality of trapezoidal tabs, each tab having a leading and a trailing portion, releaseably disposed obliquely on said backing material by means of an adhesive portion between said leading and trailing portions, said tabs being in such parallel, spaced relationship to one another that a line drawn through a trailing portion of any tab and intersecting said front and back edges at right angles intersects a portion of at least one other tab; and (c) a substantially closed housing wherein is disposed the roll, said housing including a side with an opening therein through which the backing material with the tabs thereon may be drawn, and a peeling edge adjacent the opening and along a line normal to the direction in which the backing material is drawn, over which the backing material may be further drawn, said opening being in the shape of a right triangle, said peeling edge defining one side of the triangle, and a second edge intersecting the peeling edge at an angle equal to the angle of obliquity at which the tabs are disposed on the roll defining the hypotenuse of the right triangle, so that as the leading portion of a tab is drawn over the peeling edge, one entire tab, and one only, is exposed exterior to the housing.

2. A dispensing unit for dispensing magnetic tape splicing tabs comprising:

(a) a box including:

(i) a planar bottom having parallel front and back edges and a side edge intersecting said front and back edges of said bottom at right angles, and (ii) a side lying in a plane passing through said side edge, said side having a front edge and a back edge, said front and back edges of said side being disposed parallel to one another, and a linear lower edge intersecting said front and back edges of said side at an oblique angle, whereby an opening defined by said lower edge of said side and said side edge of said bottom is disposed in the plane of said side;

(b) an elongated flexible backing strip, having a tab-carrying surface, with parallel front and back edges, said backing strip being disposed within the box with a portion of the front edge of said strip adjacent the front edge of said side, and a portion of the back edge of said strip adjacent the back edge of said side, whereby the strip may be drawn through the opening in the side to the exterior of the box;

(c) a plurality of magnetic tape splicing tabs releasably mounted on the backing strip in parallel, spaced relationship, each said tab being in underlying relationship to an elongated handling strip adhering to the tab and extending along a line intersecting the front edge of said strip at substantially the same oblique angle at which the lower edge of said side intersects the front edge of said side, said tabs being mounted generally along a center line defining the mid-point between said front and back edges of the backing strip; and (d) means for guiding the backing strip through the opening and over the side edge of said bottom.

3. The dispensing unit of claim 2 wherein the box further comprises a planar front, and wherein the lower edge of said side intersects the corner defined by the point of intersection of said front, the bottom, and said side, whereby said opening is in the shape of a right triangle, with said lower edge of said side defining the hypotenuse of the triangle.

* * * * *